US005112235A

United States Patent [19]

Enomoto et al.

[11] Patent Number: 5,112,235

[45] Date of Patent: May 12, 1992

[54] ELECTRICAL CONNECTOR

[75] Inventors: Masahiro Enomoto, Inagi; Minoru Fukushima, Yokohama, Japan

[73] Assignee: Molex Incorporated, Lisle, Ill.

[21] Appl. No.: 632,581

[22] Filed: Dec. 12, 1990

Related U.S. Application Data

[63] Continuation of Ser. No. 557,238, Jul. 25, 1990, abandoned.

[30] Foreign Application Priority Data

Aug. 1, 1989 [JP] Japan ..... 1-90903[U]

[51] Int. Cl.[5] ..... H01R 9/09

[52] U.S. Cl. ..... 439/83; 439/857; 439/862

[58] Field of Search ..... 439/80, 81, 83, 682, 439/685, 856, 857, 861, 862

[56] References Cited

U.S. PATENT DOCUMENTS

| | | | |
|---|---|---|---|
| 3,989,331 | 11/1976 | Hanlon | 439/83 |
| 4,351,582 | 9/1982 | Emerson et al. | 339/97 R |
| 4,379,611 | 4/1983 | Foege et al. | 439/857 |
| 4,645,279 | 2/1987 | Grabbe et al. | 439/862 |
| 4,738,631 | 4/1988 | Takahashi et al. | 439/248 |
| 4,815,982 | 3/1989 | Sadigh-Behzadi | 439/82 |
| 4,941,836 | 7/1990 | Bormuth | 439/247 |

*Primary Examiner*—Larry I. Schwartz
*Assistant Examiner*—Hien D. Vu
*Attorney, Agent, or Firm*—Louis A. Hecht; Stephen Z. Weiss; Charles S. Cohen

[57] ABSTRACT

Disclosed is an electrical connector comprising a multi-terminal plug and multi-terminal socket in which each female terminal is composed of a contact section, a solder tail section and intermediate curved joint integrally connected to the contact section and the soldering tail section. The curved joint of each female terminal will be yieldingly bent when an external force is applied to push the male terminal in the female terminal, thereby absorbing the external force and preventing deformation of the solder tail section, and hence peeling-off or cracking of solder at the solder tail. The intermediate curved section will also permit the contact section to float in order to compensate for the misalignment of the contact section relative to its mating pin.

15 Claims, 3 Drawing Sheets

ELECTRICAL CONNECTOR

This is a continuation of application Ser. No. 557,238, filed on July 25, 1990, now abandoned.

BACKGROUND OF THE INVENTION

The present invention relates to an electrical connector comprising a male plug and a female socket, and more particularly to a female socket having a plurality of terminals each comprised of a contact section into which a male pin is to be inserted, a solder tail section which is to be soldered to a printed circuit board, and a force absorbing intermediate joint, the opposite ends of which are integrally connected to said contact section and said solder tail section.

DESCRIPTION OF THE PRIOR ART

It is well known that two printed circuit boards can be electrically connected by an electrical connector assembly in which a male plug is mounted to one printed circuit board and a female socket is mounted to the other printed circuit board. The female socket has a plurality of female terminals, each being comprised of a contact section, a solder tail section and an intermediate section. The contact section is designed to permit the insertion of a male pin. The solder tail section is designed to be inserted into a hole in a printed circuit board and soldered to the printed circuit board. These contact and solder tail sections are integrally connected by an intermediate section in the form of "L".

The prior art electrical connector has long been used and is satisfactory for many uses. Under some circumstances, however, its performance is not satisfactory. For example, if the male terminals of a male plug which is attached to a printed board are inserted into the female terminals of a female socket which is attached to another printed board, the socket housing will be permitted to move back and forth. Because of this movement and because of the shape of the intermediate section, the force that is applied to the contact section while inserting the pin terminal into the female terminal will be applied directly to the solder tail section of the female terminal. The consequence of this force may be that the solder tail section of the female terminal is partly deformed, the part of circuit pattern to which the solder tail section is soldered is peeled off, or cracks may appear in the solder of the female terminal. The greater the density on the printed circuit board, the more likely these problems will occur because a high density package requires the use of terminals of the minimum possible size, which are inevitably fragile.

SUMMARY OF THE INVENTION

One object of the present invention is to provide an electrical connector that is capable of absorbing an external force applied to the contact section of each female terminal in the direction in which a male pin terminal is inserted into the contact section of the female terminal. This will isolate the solder tail section from this force and thus prevent deformation of the solder section, peeling-off or cracking of the solder of the female terminal, which may lead to an incomplete electrical connection.

Another object of the present invention is to provide an electrical connector which has means to prevent perpetual deformation of the intermediate joint section of each female terminal beyond recoverable deformation limits, thus assuring that each female terminal retains its force-absorbing capability for an extended time even upon the occurrence of repeated vigorous coupling and decoupling of the male and female terminals.

To attain these objects, an electrical connector is provided comprising a male plug and a female socket, said male plug having a plurality of male terminals mounted in its housing, and said female socket having a plurality of female terminals each comprised of a contact section, a solder tail section and an intermediate joint section integrally connected at its opposite ends to said contact section and said solder tail section. The contact section is mounted to a first housing, and the solder tail section is mounted to a second housing. The intermediate joint of said female terminal is of such a curved shape that it provides enough resiliency to absorb external forces applied to said female terminal in the direction in which a pin terminal is inserted in said contact section of said female terminal. The first and second housings have projections from their opposed walls that create a gap whereby said intermediate joint of each female terminal is prevented from being deformed beyond its recoverable deformation limit due to said projections abutting against each other.

The intermediate joint may be in the shape of "U" and may be flexible in directions perpendicular to the direction in which a pin terminal is inserted in the contact section, and the first housing may have a longitudinal opening elongated in the direction perpendicular to the direction in which the pin terminal is inserted in the contact section.

If the female socket is attached to a printed circuit board with the first housing somewhat loosely fixed to the printed circuit board to permit the first housing to move back and forth slightly, when a male pin terminal is inserted into the contact section of a female terminal in the first housing, an external force will be directed to the contact section in the direction in which the male pin terminal is inserted. The curved intermediate joint will be yieldingly bent to substantially absorb the external force, thereby minimizing the external force applied to the solder tail section. As a result, peeling-off or cracking of the solder will be minimized. Once the pin terminal is inserted, the external force will no longer be present and the curved joint will restore to its normal, stress free position.

The distance between the opposed projections of the first and second housings is determined so as to prevent the bending of the curved intermediate joint beyond its recoverable deformation limit even if a strong pin-insertion force is applied to the contact section. Thus, no perpetual deformation will result to the curved intermediate joint.

Other objects and advantages of the present invention will be understood from the following description of an electrical connector according to one preferred embodiment of the present invention, which is shown in accompanying drawings.

DETAILED DESCRIPTION OF THE PREFERRED EMBODIMENT

Figure 2:
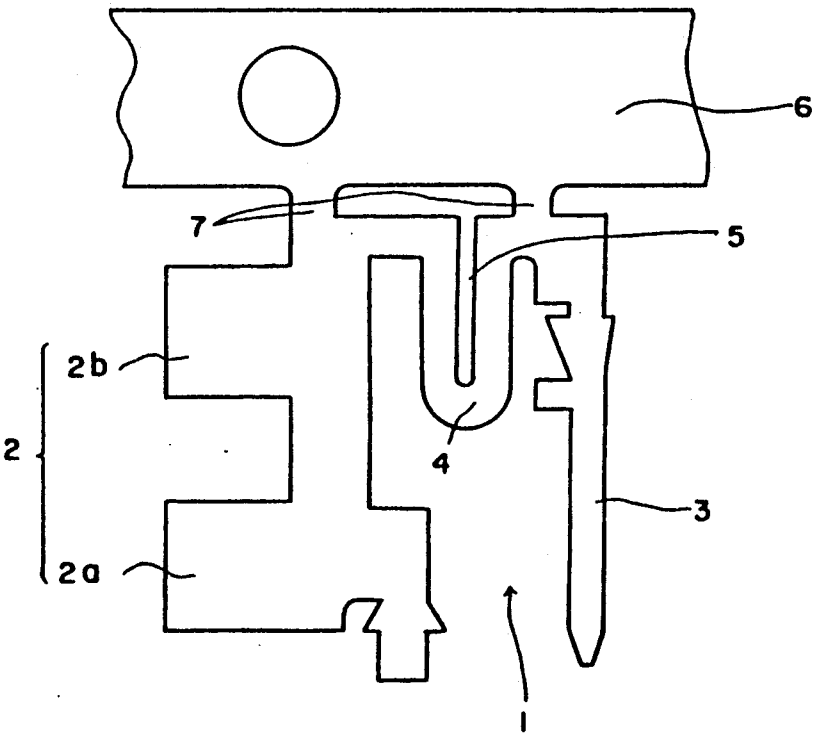
FIG. 2 shows a development pattern of the female terminal.
Figure 1:
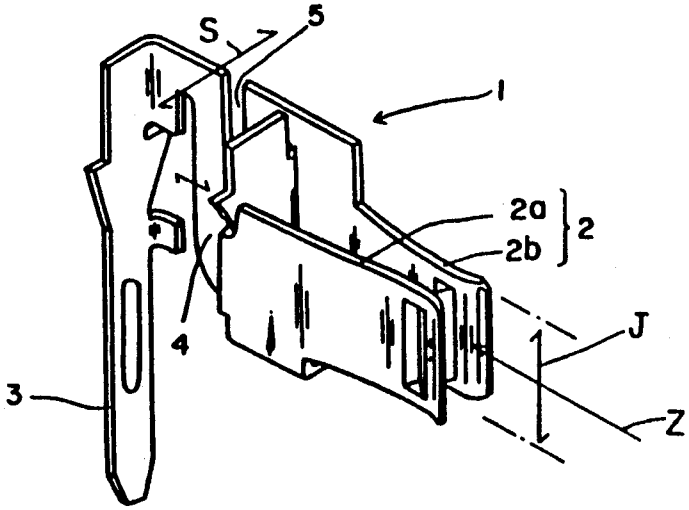
FIG. 1 is a perspective view of a female terminal of the present invention.

FIGS. 1 to 5 show a female terminal indicated generally at 1 which is used in an electrical connector according to the present invention. Female terminal 1 is made from a thin metal sheet of good conductivity. In known manner, a terminal pattern is stamped out from a metal sheet (FIG. 2) and is folded into a female terminal structure 1. Such structure comprises contact section 2 having parallel-spaced, opposite contact pieces 2*a* and 2*b*; solder tail section 3; and curved intermediate joint section 4 whose opposite ends are integrally connected to contact section 2 and solder tail section 3.

In one embodiment of the present invention, intermediate joint 4 is shaped in the letter "U" having gap 5 between its opposite legs. "U"-shaped joint 4 is dimensioned so that upon inserting male terminal 18 into female terminal 1 (FIG. 10), "U"-shaped joint 4 yieldingly deforms to absorb a portion of the external force in the direction Z. Thus, "U"-shaped joint 4 functions as a resilient deformation area to absorb a portion of an external force and prevent the force from being transferred to solder tail section 3, effectively isolating solder tail 3 from the insertion force. Alternatively, intermediate joint 4 can take a different shape such as in the shape of the letters "V", "W" or "M", so long as the shape will absorb a portion of the insertion force in order to isolate the solder tail section 3.

FIG. 2 shows a terminal pattern which is stamped out of a thin metal sheet. A plurality of terminal patterns are integrally connected to carrier band 6. Each pattern is folded into a female terminal in known manner. Because the terminals are made of thin metal sheet, the curved joint 4 of the female terminal 1 is easily bendable in a direction S (FIGS. 1 and 4) perpendicular to the direction Z in which a pin terminal is inserted into female terminal 1.

FIGS. 6-10 show female terminals inserted into a female socket housing. Contact section 2 of each female terminal 1 is fitted in first housing 8 of the socket, and is oriented with respect to pin-insertion aperture 13 of first housing 8 to allow a pin terminal to be inserted into contact section 2 of female terminal 1. Solder tail section 3 of female terminal 1 is fitted in second housing 9, allowing part of the tail section to appear from the bottom surface of second housing 9. Intermediate joint 4 of female terminal 1 is exposed between first and second housings 8 and 9 of the socket. Thus, the resilient, force-absorbing "U"-shaped section 4 of each female terminal is between first and second housing 8 and 9.

With such a structure, "U"-shaped section 4 can be yieldingly deformed when an external force is applied to female terminal 1 upon insertion of pin terminal 18 therein, and will return to its initial, stress-free position when the external force is removed. To assure such performance it is necessary to prevent the intermediate joint 4 from being deformed beyond its recoverable deformation limit. For this purpose, two projections 10*a* and 10*b* (FIG. 6) are integrally connected to rear surface 15 of first housing 8. The rear surface 15 faces the front surface 16 of second housing 9. Two projections 11*a*and 11*b* are integrally connected to front surface 16 of second housing 9.

Figure 6:
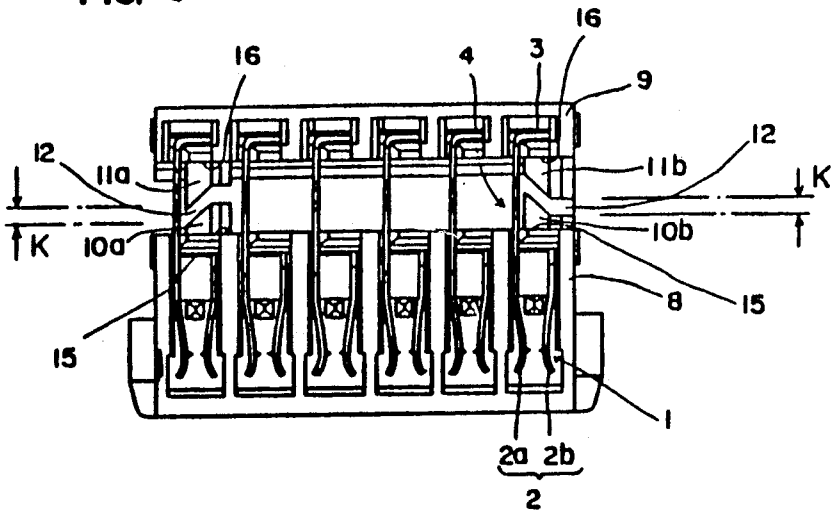
FIG. 6 is a top view of an electric connector.
Figure 7:
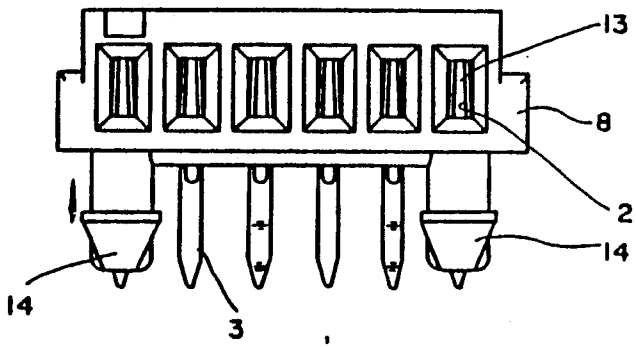
FIG. 7 is a front view of the female socket of an electric connector of the present invention.

As best shown in FIG. 6, projection 10*a* faces projection 11*a*, leaving gap 12 therebetween and projection 10*b* faces projection 11*b*, leaving gap 12 therebetween. The gap 12 is dimensioned so that 10*a* and 11*a*, and 10*b* and 11*b*, will contact each other prior to over-stressing curved joint 4. In this particular embodiment, each projection has an angled surface.

First housing 8 has elongate pin receiving slot 13 positioned in the direction J perpendicular to the direction Z in which a pin terminal 18 is inserted into the female terminal 1. Both slot 13 and contact section 2 may be dimensioned in direction J substantially greater than pin terminal 18. Thus, even if a male plug is attached to a printed board somewhat inexactly in the direction J, the dimensions of elongated slot 13 and contact section 2 will permit insertion of male terminal 18 into contact section 2 of female terminal 1. Due to its shape and size, female terminal 1 is capable of yieldingly deforming at its joint section 4 in the direction Z, and of bending in directions S and J.

Figures 3, 4, 5, 10:
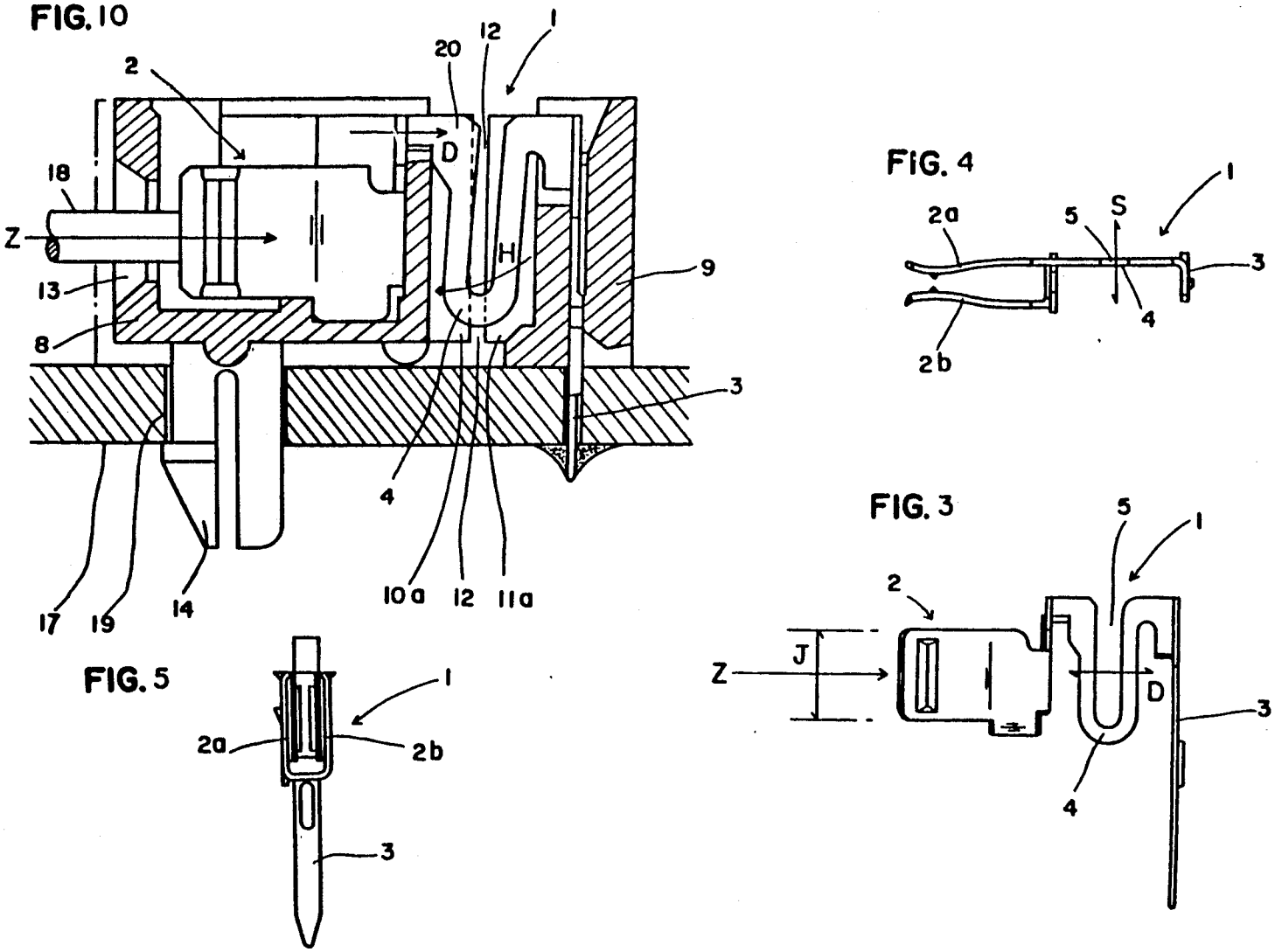
FIG. 3 is a side view of the female terminal.
FIG. 4 is a top view of the female terminal.
FIG. 5 is a front view of the female terminal.
FIG. 10 is a sectional view of the female socket with a male terminal inserted therein.
Figure 9:
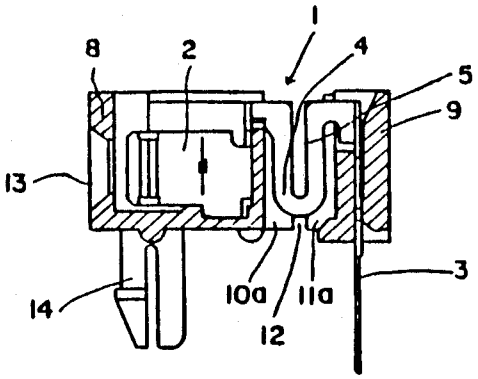
FIG. 9 is a sectional view of the female socket of the electric connector taken along the line 9-9 in FIG. 7.
Figure 8:
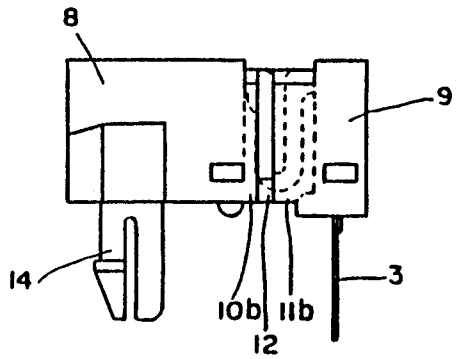
FIG. 8 is a side view of the female socket of the electric connector.

As shown in FIG. 10, first housing 8 has stopper 14 extending down from its bottom. Aperture 19 in printed circuit board 17 is made somewhat larger than the diameter of stopper 14, thereby permitting positional adjustment of first housing 8.

In use, the female socket is attached to printed board 17. Specifically, stopper 14 of first housing 8 is pushed into aperture 19, and solder tail section 3 of each female terminal is soldered to the circuit pattern of printed board 17 (FIG. 10). The male plug may be attached to another printed circuit board or another device or cable. Each male terminal 18 is inserted into contact section 2 of female terminal 1, thus completing the electrical connection therebetween.

Insertion of each male terminal 18 into female terminal 1 will cause the application of an external force D to portion 20 (FIG. 10) of "U"-shaped joint 4. As a result, "U"-shaped joint 4 will be yieldingly bent to absorb the external force as indicated by arrow H, thereby minimizing the application of the external force to solder tail 3. By minimizing this force, deformation of solder tail section 3 can be prevented which in turn prevents peeling-off or cracking of the solder.

After insertion of every male terminal 18 in its respective female terminal 1, the extra force will be removed and "U"-shaped joint 4 of each female terminal 1 will be restored to its initial, stress-free position. Application of excessive force will cause opposed projections 10*a*, 10*b*, and 11*a*, 11*b* of first and second housings 8 and 9 to abut against each other, thereby preventing deformation of "U"-shaped joint 4 beyond its recoverable deformation limit.

It is also possible that a male plug and/or a female socket may be attached to associated printed circuit boards somewhat aside from the exact position, for example, along the direction S. The "U"-shaped joint 4 is also flexible enough in lateral direction S to permit positional adjustment of female terminal 1 with respect to male terminal 18. Elongated slot 13 of first housing 8 is dimensioned so that female terminal 2 can move slightly within slot 13. This feature combined with the movable mounting of first housing 8 with respect to printed circuit board 17 permit positional adjustment of female terminals 1 with respect to male terminals 18, thereby permitting the male and female terminals to mate with each other irrespective of deviation of the male plug and/or female socket from their exact positions. Accordingly, the connector of the present invention not only isolates solder tail 3 from insertion forces, but also permits contact 2 to "float" sufficiently to permit proper mating of pin 18 and contact 2 even if the female terminal 1 or male pin 18 are imprecisely positioned.

It will be understood that the embodiment of the present invention that has been described herein is merely illustrative of an application of principles of the invention. Modifications may be made by those skilled in the art without departing from the spirit and scope of the invention.

What is claimed is:

1. An electrical connector comprising:

a dielectric housing having first and second passageways;

an electrically conductive contact member being disposed within said first passageway for receiving an electrically conductive pin inserted into the passageway in a given direction;

an electrically conductive solder tail member being disposed within said second passageway and being electrically connected to said contact member;

resilient planar spring means intermediate said contact member and said solder tail member, said spring means having at least two leg members oriented generally transverse to said given direction and a base member intermediate said leg members, said spring means permitting said contact member to move relative to said solder tail member during insertion of a pin into said contact member; and means for preventing over-stressing of said spring means.

2. An electrical connector as in claim 1 wherein said contact member, said solder tail member and said resilient spring means are formed from a single piece of conductive sheet metal.

3. An electrical connector as in claim 2 wherein said resilient spring means is "U"-shaped.

4. An electrical connector as in claim 3 wherein said means for preventing over stressing comprises a mechanical stop.

5. An electrical connector as in claim 3 wherein said first passageway is sufficiently larger than said contact member so that said contact member can move transversely relative to said passageway in order to compensate for misalignment of said contact member relative to a pin to be inserted therein.

6. An electrical connector comprising:

a male plug having at least one electrically conductive pin;

a female receptacle having first and second dielectric housings, each having passageways therein; and at least one electrically conductive female terminal, said female terminal having a contact section disposed within said passageway of said first housing for receiving an electrically conductive pin inserted into the passageway of said first housing in a given direction; a solder tail section being electrically connected to said contact section and disposed within said passageway of said second housing; and a resilient planar spring section intermediate said contact section and said solder tail section; said spring section having at least two leg members oriented generally transverse to said given direction and a base member intermediate said leg members, said spring section permitting said first housing and said contact section disposed therewithin to move relative to said second housing and said solder tail section deposed therewithin.

7. An electrical connector as in claim 6 which further comprises means for preventing over-stressing of the resilient spring section.

8. An electrical connector as in claim 7 wherein said contact section, said solder tail section, and said resilient spring section are formed from a single piece of conductive sheet metal.

9. An electrical connector as in claim 8 wherein said resilient spring section is "V"-shaped.

10. An electrical connector as in claim 8 wherein said resilient spring section is "W"-shaped.

11. An electrical connector as in claim 8 wherein said resilient spring section is "M"-shaped.

12. An electrical connector as in claim 8 wherein said resilient spring section is "U"-shaped.

13. An electrical connector as in claim 9 wherein said passageway in said first housing and said contact section are substantially larger in the vertical direction to permit proper mating of an electrically conductive pin with said contact section in the event that said pin and said contact member are not in the same horizontal plane.

14. An electrical connector as in claim 9 wherein said means for preventing over-stressing comprises a mechanical stop located on at least one of said first and second housings.

15. An electrical connector as in claim 13 wherein said mechanical stops are opposed projections from said housings dimensioned to abut against each other in order to prevent additional relative movement of the housings prior to said resilient spring section being over-stressed.

* * * * *